US007785173B2

(12) United States Patent
Klotz

(10) Patent No.: US 7,785,173 B2
(45) Date of Patent: Aug. 31, 2010

(54) SUPERFINISHING MACHINE AND METHOD

(75) Inventor: Norbert Klotz, Providence, RI (US)

(73) Assignee: Supfina Machine Co., Remscheid (DE)

( * ) Notice: Subject to any disclaimer, the term of this patent is extended or adjusted under 35 U.S.C. 154(b) by 489 days.

(21) Appl. No.: 11/364,900

(22) Filed: Feb. 27, 2006

(65) Prior Publication Data

US 2007/0010171 A1 Jan. 11, 2007

(51) Int. Cl.
*B24B 49/00* (2006.01)

(52) U.S. Cl. ..... 451/11; 451/57; 451/210; 451/292; 451/401

(58) Field of Classification Search ..... 451/11, 451/57, 210, 292, 401
See application file for complete search history.

(56) References Cited

U.S. PATENT DOCUMENTS 1,432,093 A * 10/1922 Taylor ..... 451/247
1,606,813 A 11/1926 Schultz
1,888,710 A * 11/1932 Arter et al. ..... 451/218
2,003,269 A * 5/1935 Arter et al. ..... 451/221
2,140,019 A * 12/1938 Lewis ..... 29/38 A
2,168,596 A 8/1939 Hall
2,220,425 A * 11/1940 Potter ..... 29/44
2,413,334 A * 12/1946 Pieper ..... 451/292
2,417,737 A 3/1947 Culp
2,507,998 A * 5/1950 Russell ..... 451/49
3,153,276 A * 10/1964 Herbkersman ..... 29/38 C
3,821,835 A * 7/1974 St. Andre et al. ..... 29/36
3,874,122 A 4/1975 Ward
3,959,928 A 6/1976 Schmitz
3,974,553 A * 8/1976 Reiger et al. ..... 29/38 C
4,006,518 A * 2/1977 Rudolph et al. ..... 29/39
4,024,672 A 5/1977 Wieck
4,048,764 A 9/1977 Schmitz
4,052,821 A * 10/1977 McCandless et al. ..... 451/149
4,222,203 A 9/1980 Wolff et al.
4,478,008 A 10/1984 Dunn
4,478,009 A 10/1984 Rukavina et al.
4,524,547 A 6/1985 Heaston et al.
4,558,537 A 12/1985 MacLeod et al.
4,742,609 A * 5/1988 Neumann ..... 483/3
4,782,567 A * 11/1988 Kanaya et al. ..... 29/33 P (Continued)

FOREIGN PATENT DOCUMENTS

DE 10016897 10/2001

(Continued)

OTHER PUBLICATIONS

Web Page Pibomulti turret.*

(Continued)

*Primary Examiner*—Maurina Rachuba
(74) *Attorney, Agent, or Firm*—Karl F. Milde, Jr.; Eckert Seamans; Cherin & Mellott, LLC

(57) ABSTRACT

A superfinishing system and method, wherein an abrasive is employed to process a workpiece, and wherein the system simultaneously mounts a plurality of workpieces in a diagonal turret, or mounts a plurality of different types of workpieces in a plurality of chucks for different operations thereon, or performs a plurality of different operations on the same workpiece without remounting. The system improves throughput by allowing flexibility in the operation and multitasking.

22 Claims, 9 Drawing Sheets

U.S. PATENT DOCUMENTS 4,809,425 A * 3/1989 Monforte ..... 483/1
4,811,523 A 3/1989 Schmitz et al.
4,827,677 A 5/1989 Schmitz
4,845,900 A 7/1989 Suzuki et al.
5,025,595 A 6/1991 Orain
5,042,203 A 8/1991 Kobayashi
5,056,266 A 10/1991 Norris
5,097,635 A 3/1992 Beasley
5,218,550 A * 6/1993 Kato ..... 700/192
5,245,793 A 9/1993 Schmitz
5,254,068 A * 10/1993 Yamada et al. ..... 483/14
5,353,553 A 10/1994 Miller
5,381,630 A 1/1995 Kinner
5,425,666 A 6/1995 Frank et al.
5,437,125 A 8/1995 Barton
5,447,463 A 9/1995 Schmitz
5,496,207 A 3/1996 Hornung et al.
5,641,321 A 6/1997 Suzuki
5,658,187 A 8/1997 McCoy
5,681,209 A 10/1997 Naumann et al.
5,695,391 A 12/1997 Steinwender
5,718,617 A 2/1998 Priestley et al.
5,720,652 A 2/1998 Steinwender et al.
5,722,878 A 3/1998 Phillips
5,779,518 A 7/1998 Schmitz
5,785,578 A 7/1998 Thoresen et al.
5,803,796 A 9/1998 Barton
5,816,899 A 10/1998 Hart et al.
6,095,907 A 8/2000 Greenman et al.
6,110,031 A 8/2000 Preston et al.
6,203,401 B1 3/2001 Weber
6,409,573 B1 6/2002 Mukai et al.
6,575,672 B1 6/2003 Maier
6,726,525 B1 4/2004 Kato et al.
6,735,868 B2 5/2004 Loose et al.
6,872,124 B2 3/2005 Matsuzaki et al
6,881,498 B1 4/2005 Cooper et al.
6,887,288 B2 5/2005 Hokkirigawa et al.
6,957,121 B2 10/2005 Lottgen et al.
7,014,540 B2 3/2006 Nagel
2005/0020198 A1 1/2005 Nagel

FOREIGN PATENT DOCUMENTS

JP 6-226510 * 8/1994
JP 9-103980 * 4/1997

OTHER PUBLICATIONS

English language translation of JP 09-103980.*

* cited by examiner

SUPERFINISHING MACHINE AND METHOD

BACKGROUND OF THE INVENTION

1. Field of the Invention

This invention relates to high throughput cup wheel superfinishing systems and methods therefore, in particular relating to workpiece identification, loading, unloading and repositioning.

2. Description of the Prior Art

Superfinishing is a well known process in which an outer surface of a workpiece is removed, using a process which generates little heat or surface stress, to produce a smooth surface having a precise contour and properties similar to the bulk material.

A superfinishing operation can be performed on almost any previously machined surface which may have a flat, cylindrical, spherical or other specific configuration. It improves the finish of the previously machined surface by removing surface material or "smear metal" left by the previous machining operation, and by cutting off ridges on the base metal surface of the workpiece. Superfinishing can also effect small corrections in the dimensions or shape of the workpiece. A superfinished surface is also characterized by a pattern of minute scratch marks which are beneficial for purposes of lubrication. Such scratch marks may take the form of a cross-hatched pattern cut by a combination of workpiece and stone movements.

Known processes employ, for example, a fine abrasive cup wheel to produce an abrasive pattern having a relatively constant relative velocity, which due to the rotation of the cup and workpiece, acts on the surface at in an area contact at nearly right angles, producing the characteristic cross hatch surface pattern. The process is typically controlled to apply a constant force on the workpiece surface, with the cup wheel spinning rapidly and the workpiece moving slowly, so that the cup wheel provides a treatment to all regions of the surface at least once (and in general, many times). This arrangement is useful for finishing planar or spherical surfaces.

A conventional superfinishing stone is formed as a block of solid abrasive material and relies on a coolant, commonly of relatively high viscosity, flooded over the stone and workpiece surface by means of external supply nozzles or by immersion. Such conventional stones are specially compounded to the user's specifications as to size, grit material, bond and hardness.

Typically, a superfinishing operation is controlled based on a pressure of the abrasive on the workpiece. This provides uniformity of treatment over corresponding parts of respective workpieces, and to the extent topological issues are resolved, globally uniform treatment, regardless of original surface configuration. This, in turn, requires a close loop servo feedback control system, to position the workpiece and abrasive in accordance with their relative force.

SUMMARY OF THE INVENTION

With the foregoing considerations in mind, a first object of the present invention is to provide a superfinishing system and method which provides automated loading, positioning, and unloading of the workpiece into the apparatus.

By providing an automated workpiece handing system, the process is facilitated and manual efforts eliminated. This automation therefore potentially allows greater productivity, both of the machine which works continuously, and of the human operator, who can manage a number of workcenters simultaneously or perform other tasks.

A turret (i.e., a diagonal turret) provides a set of elements which have axes which are inclined with respect to each other, and thus a workpiece in one turret location has both a different position and a different inclination than a workpiece in another turret location. An index table, on the other hand, maintains the axes of the workpieces in parallel relation.

While machining turrets are known, typically these are provided for machining tools, not workpieces, and are typically designed with the tool in an active tool position facing horizontal or vertically downward. The turret may be fluid filled, and include hydraulic elements, so that a change in orientation from a downward tool direction may result in difficulties in operation. Likewise, the turret, though typically designed to be tolerant to cooling fluid, is typically not designed to be bathed in fluid, as would be expected if the turret is used to mount a workpiece for a superfinishing operation, which requires a substantial fluid flow. A turret design provides a relatively open space in the same plane as the vertical spindle, since the opposite spindle is horizontal, facilitating visualization of the process, and loading and unloading of non-machining spindles. The use of a turret may result in a space savings on the base of the machine, and therefore occupy less floor space than an index table design.

Known superfinishing systems which employed index tables were not capable of handling different types of workpieces, although a system was known which processed opposite faces of a single type of workpiece sequentially, in different chucks, with an automated system for inserting the workpiece, flipping it, and then extracting it to a finished workpiece area. This type of system is specially designed for a single application, and thus is not particularly adaptable. The present invention advances this system by providing for the use of an incremental rotatory index table, for example a direct drive index table, to selectively control an offset between the cup wheel axis and workpiece axis, to avoid or mitigate the need for control over this offset on the cup wheel drive mounting, and allow different positions of workpiece axis relative to the machining axis. This control also allows processing of two different surfaces of a workpiece (or a plurality of workpieces simultaneously) without remounting.

A second object of the invention provides automated superfinishing of two different surfaces of the workpiece according to different processing parameters.

In various embodiments, it is possible to provide a mechanism for replacing or interchanging a cup wheel, although the changeover time may mitigate the advantages of the present system. For example, an index table or turret may be provided to mount the cup wheel as well.

In processing two surfaces whose tolerance are to be tightly held relative to each other, the present invention provides a system and method wherein first and second operations are chained in a sequential process, without unmounting the workpiece, so that the surface as actually produced in the first process serves as a positional reference for the second surface. Since a servo-drive may be employed for advancing the cup wheel along its axis, the position information may be acquired from this system, alleviating the need for a separate gauge or gauging operation.

A third object provides a multiposition turret having a chuck at each position for rotating a workpiece during superfinishing, wherein different positions are adapted for different workpieces or use of different superfinishing parameters. Each chuck may be encoded, so that the system will automatically recognize the workpiece and its associated processing parameters.

Another advantage of a turret system is that it allows "live spares". That is, in the event that a workpiece chuck or spindle is damaged, another chuck may be enlisted to serve its purpose. Since the changeover may be automated, this can improve the reliability and/or "uptime" of the system, an important characteristic for superfinishing machines, which are often used in high production environments.

A fourth object of the invention provides a robotic arm for loading and unloading of the workpiece, e.g., at a non-machining location of the turret, wherein the robotic arm is mounted on a common base with the workpiece drive spindle. This arrangement reduces alignment issues as compared to separate bases. In this case, it is important to provide a splash guard which blocks most of the cooling fluid from washing over the robotic arm, while allowing free access to the loading position. Since the preferred turret is a 45 degree diagonal turret, a splash guard may be provided which has a lower angled plate which divides the turret between upper and lower portions, with the upper portion being subjected to cooling fluid spray and the lower portion isolated from it. The angled play may have apertures corresponding to the shape of the turret and spindles, leaving only a small opening for fluid to leak out. The robotic arm and bottom portion of the turret may be housed within a secondary cabinet, to maintain all fluid within the system, and to protect the operator from harm during operation.

A fifth embodiment of the invention provides an index table, that is, a set of workpiece holders mounted having spindle axes parallel to each other, on a rotatable plate, allowing the different workpiece holders to move between various positions. According to the present invention, the index table may be driven to an arbitrary position, rather than a mechanically predetermined stop position, allowing selectively controllable offset between a workpiece axis and a cup wheel axis. Since this offset is controllable from the workpiece side, there is no need to provide control over this axis from the cup wheel side, potentially simplifying the construction and control of the system.

According to the first object, a turret, having a plurality of positions and at least one active position in which a spindle is driven for rotation, is employed to hold, position and rotate the workpiece with respect to the cup wheel. For example, a workpiece may be loaded into the turret at a first position, superfinished at a second position, and unloaded at a third position. Alternately, the workpiece may be loaded and unloaded at the same position. Advantageously, the turret may be a standard machining turret, configured to rotate the workpiece rather than a tool. The superfinishing abrasive cup is provided on a second spindle, which is controlled by a process feedback controller.

Typically available turrets have only a single driven spindle position; however, in a modified turret design, a plurality of workpieces may be rotatably driven at a single time, potentially allowing superfinishing of a plurality of workpieces in a single apparatus. This may be advantageous, for example, where a single set of workpiece loading/unloading systems is provided for multiple working positions, where a single workpiece is to be processed under a plurality of sequential conditions (e.g., different cup wheel, etc.), or otherwise.

It is noted that in typical milling and drilling machining operations, in which such turrets are normally applied, the turret supports the cutting tool, and not the workpiece.

According to the second object, two surfaces, for example a flat end surface and an annular planar surface projecting from a cylinder, are both to be superfinished. Typically, these would be treated as two different operations, since the parameters of optimal treatment differ. According to the present invention, a plurality of sets of control parameters are sequentially employed by the control, to first treat one surface, and then treat the other surface, without unloading the workpiece.

Typically, the surfaces to be superfinished are at different depths. Traditionally, one would gauge the relative depth between surfaces or absoluter depth of each surface, and index the cup wheel to the appropriate position. On the other hand, according to the present invention, the fact that the process is process feedback controlled allows the system to reposition the abrasive with respect to the surface in the plane of the surface, and to then allow the control to find the working depth by itself.

Thus, according to this embodiment, the control must store and appropriately employ two different control parameter sets for each workpiece, which is not the norm for superfinishing systems.

According to the third embodiment, a single machine may be placed within multiple workflows, without a change in setup. A multiposition turret is provided, which is preferably associated with one or more automated feeds and/or removal mechanism to insert the superfinishing machine into an automated flow. Typically, a superfinishing machine is set up for a single type of workpiece, which is inserted and extracted from the chuck in its normal operating position. According to the present embodiment, a plurality of chucks are provided on a turret, which is automatically controlled. Each chuck can be adapted for a different workpiece, so, without a change in setup, the machine can operate on different workpieces with different superfinishing processes, simply by calling a superfinishing operation associated with a particular chuck (turret position). A sensor may be provided to determine whether a chuck is occupied. After completion of processing, the workpieces may be extracted into separate workflows, for example by having separate automated insertion and extraction mechanisms for the different chucks or chuck types.

Another advantage of the index programming embodiment is that it facilitates "just in time" production methods, since the workflow through the machine can be efficiently allocated between jobs on a piece by piece basis. Even if a separate automated mechanism is not available for loading and unloading the chuck, the embodiment still has merit, since adjusting or replacing the feed may be less cumbersome than retooling the entire operation.

It is noted that the cup wheel selection and replacement may also be automated, using either a single spindle or turret design. A single spindle is preferred.

The control for the superfinishing system and method therefore includes a memory for storing a plurality of processing programs or parameters therefore, which are selectively retrieved and loaded based on a required superfinishing operation as determined by a type of workpiece, a surface of a workpiece, and/or other parameters.

The embodiments of the present invention are designed to work in conjunction with existing elements of superfinishing machines, including the products of Supfina Machine Co., Inc. (N. Kingstown, R.I.), and in conjunction with workcenter automation systems of known types.

In general, a first type of automation system employs relatively special purpose single axis or double axis mechanisms which, using a simple sequence, load or unload, or in some cases, both load and unload, workpieces from the chuck. In order to reduce complexity, it is preferred that the loading and unloading occur at different locations, using different mechanisms. Such automated systems may be relatively low cost and small, but are limited in functionality and flexibility. This type of mechanism can be especially efficient for small workpieces which are arrayed in a line or tube.

A second type of automation system employs a general purpose automated mechanism, such as an industrial robot, which can be programmed to perform multiple operations and provide sophisticated motion control and sensing. Such systems are generally more expensive than dedicated mechanisms, but through programming can affect a variety of operations. Due to this flexibility, loading and unloading may be affected at a single position. This type of mechanism is well suited for larger workpieces, or those which are arrayed in a tray or otherwise require manipulation for insertion or extraction.

DESCRIPTION OF THE PREFERRED EMBODIMENTS

Prior Art

Figure 1:
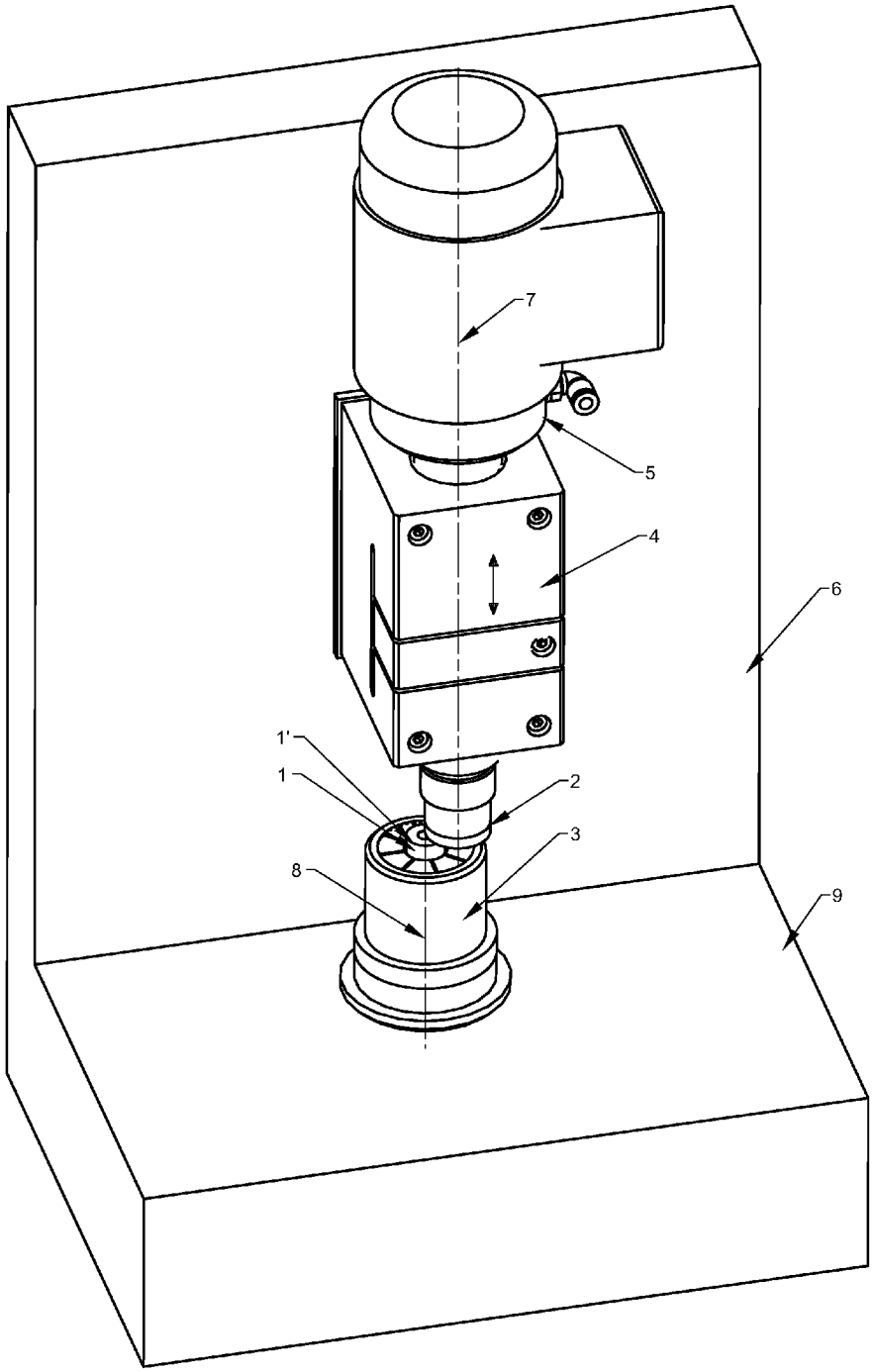
FIG. 1 PRIOR ART
FIG. 1 shows a prior art superfinishing apparatus having a first spindle and chuck rotating the workpiece and a second spindle rotating the abrasive cup wheel, and wherein the processing must be interrupted for loading and unloading of the workpiece.

FIG. 1 shows a typical cup wheel superfinishing apparatus. In this type of system, a cup wheel 2 spins rapidly, for example 10,000 RPM. The workpiece 1 also moves relative to the cup wheel 2, so that the entire surface 1' to be treated contacts the cup wheel 2. In this case, the workpiece 1 also rotates, for example at 500-3500 RPM. The axis of the cup wheel 7 is offset from the axis of the workpiece 8, and depending on the relative angles, produces a spherical surface with positive (convex), or negative (concave) curvature, or having an infinite radius (planar). There are thus a number of mechanical adjustments, in addition to selection of the cup-wheel 2, including the advancement of the cup wheel along its axis 7, the radial displacement of the cup wheel axis 7 and the workpiece axis 8, and the angle of the cup wheel axis 7 with respect to the workpiece axis 8.

In general, the type of superfinishing operation encompassed by the preferred embodiments of the present invention provide a spinning cup wheel 2 on a different axis 7 (which may be parallel or inclined) than a spinning axis 8 of the workpiece 1. The workpiece 1 typically spins more slowly than the cup wheel 2, and the process is controlled by a constant force or pressure, or other control system (not shown) to provide a constant pressure between the cup wheel 2 and the workpiece 1, which leads to a controlled removal of material. The workpiece 1 material removal is typically controlled based on a gauge measurement, but in some cases where tolerances are not critical, the gauge may be dispensed with. If the axes of the cup wheel 7 and workpiece 8 are parallel, the resulting processed surface is planar, while if the axes are inclined, a spherical surface is produced. Because the cup wheel 2 has a leading and trailing edge in contact with the workpiece 1, a characteristic cross-hatch pattern is produced on the workpiece 1. Typically, a stream of coolant (not shown) is provided to lubricate, rinse and cool the workpiece 1 during processing, and it is possible to monitor acoustic emissions into this stream to analyze and control aspects of the process. Other possible control parameters include normal force, torque, deflection, and vibration sensing of the mechanism.

In FIG. 1, the abrasive wheel 2 is rotated by a spindle motor 5 at a high speed. The chuck 3 is mounted on a spindle (not shown), which rotates the workpiece 1 at a speed lower than that of the abrasive cup wheel 2. The chuck 3 is pressed towards the cup wheel 2 by means of pressure caused by a feed system 4 with a lead screw (not shown) so that the surface 1' to be worked of the workpiece 1 is brought into contact with the cup wheel 2 surface.

The process is controlled to provide a minimum processing of all portions of the workpiece 1, which is maintained until the appropriate amount of material removal or other parameter is met.

As shown in FIG. 1, the feed system 4 is mounted on a wall 6, which is rigidly connected to a base 9, to maintain critical position and alignment through the process. A spray of cooling fluid is provided on the workpiece 1 and exterior of the cup wheel 2, by a nozzle (not shown).

First Embodiment

Figure 2:
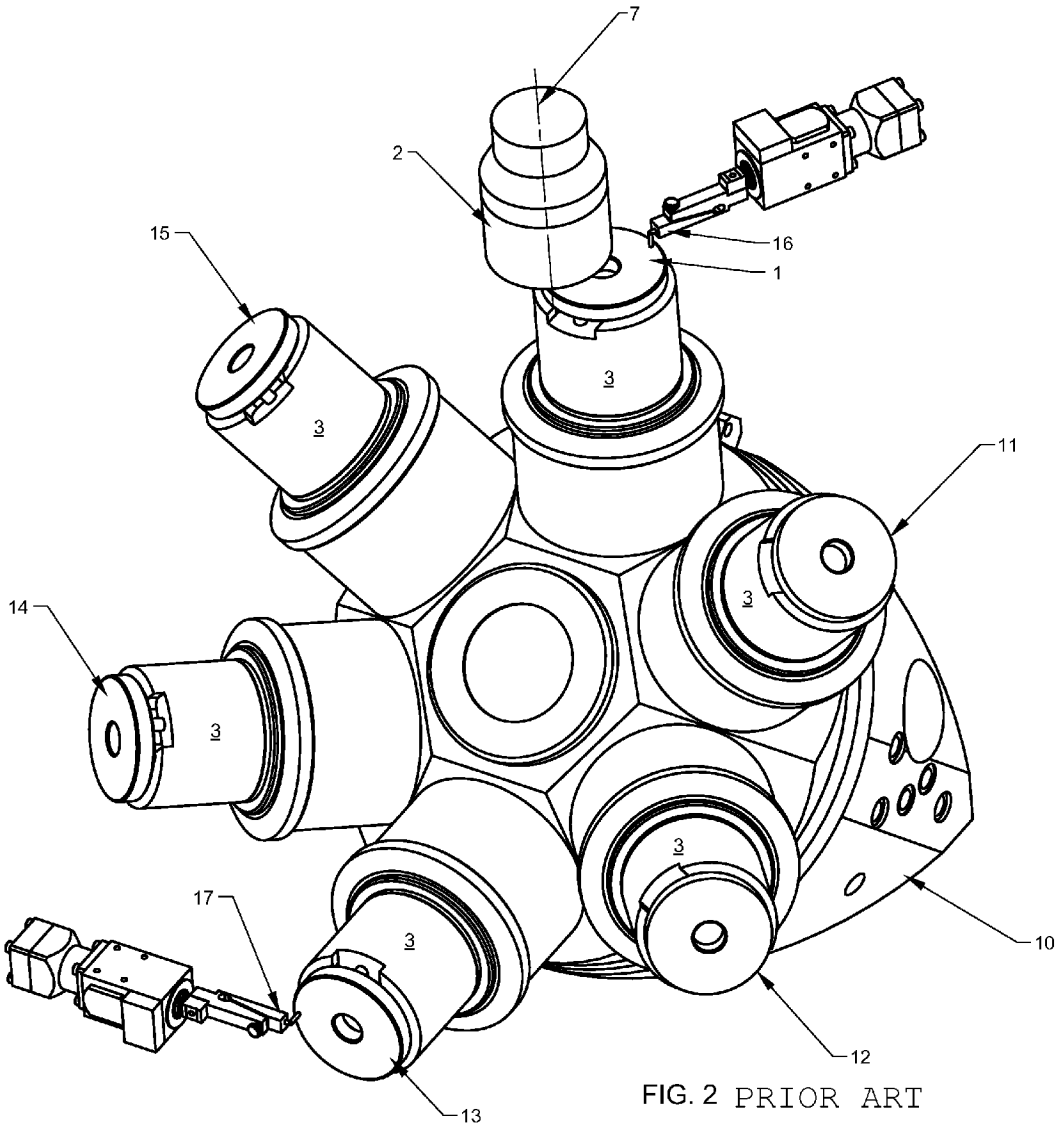
FIG. 2 PRIOR ART
FIG. 2 shows a first embodiment in which the workpiece chuck is mounted on a turret, and therefore loading, unloading and certain types of gauging may proceed concurrently with the processing of another workpiece.

FIG. 2 shows a superfinishing apparatus having a set of chucks 3 mounted on respective spindles of a turret 10. In this arrangement, the superfinishing operation can proceed simultaneously with loading and unloading, and/or a gauging process may be conducted prior to, during an intermediate step, or after the process, by a gauge 17 located in conjunction with a workpiece 13 in a non-machining chuck, without unduly reducing process throughput. Of course, gauging may also be conducted in-process by a gauge 16 located in conjunction with a workpiece 1 in a machining chuck. Thus, the superfinishing process may proceed while secondary operations are performed at different turret stations.

The preferred turret is a Pibomulti 256, 356, or 358, which provides a single electrical servomotor to both position the turret and drive the spindle in at single turret location. The turret 10 permits loading and unloading through a hydraulically clamp at a single position.

As shown in FIG. 2, the abrasive wheel (cup wheel) is designated at 2. The chuck 3 or clamping fixture shown in FIG. 1 is placed on a turret 10, which is rotationally driven by a spindle (not shown), internal to the turret 10. The chuck 3 is, for example, operated hydraulically. The cup wheel 2 is moved quickly along its axis 7 toward the workpiece 1 until there is contact, in order to speed processing and reduce cycle times. Typically, the initial contact or "crash" is detected through a sensor or process parameter change, and the feed rate of the feed system 4 is slowed to appropriate processing speed(s) until the process is complete. The process is, for example, controlled based on a process parameter correlated to the cutting force, to ensure the process remains within appropriate limits. If the material removal is attempted at too high a speed, heat is generated which can damage the cup wheel 2, or alter the characteristics of the workpiece 1 in an undesired fashion, or simply produce an unacceptable finish. Slow speeds result in prolonged processing, decreasing throughput.

The turret 10 may have any number of positions, for example holding six workpieces 1, 11, 12, 13, 14, 15. Typically, only a single chuck 3 of the turret 10 is driven for rotation, although turrets with multiple driven spindles may be employed. The turret 10 may include various sensors, such as chuck loading status, turret position, rotational speed, torque, force, vibration, and the like, which may advantageously be employed by the control system (not shown). Typically, a single control system is employed to control the superfinishing operation, in particular the advancement of the feed system 4 and turret 10, although separate but coordinated systems may be implemented.

Another advantage of a turret 10 mechanism is that it provides possible redundancy of workpiece chucks 3, and therefore allows a machine to remain operational even if one turret 10 position becomes defective or unavailable.

Figure 3:
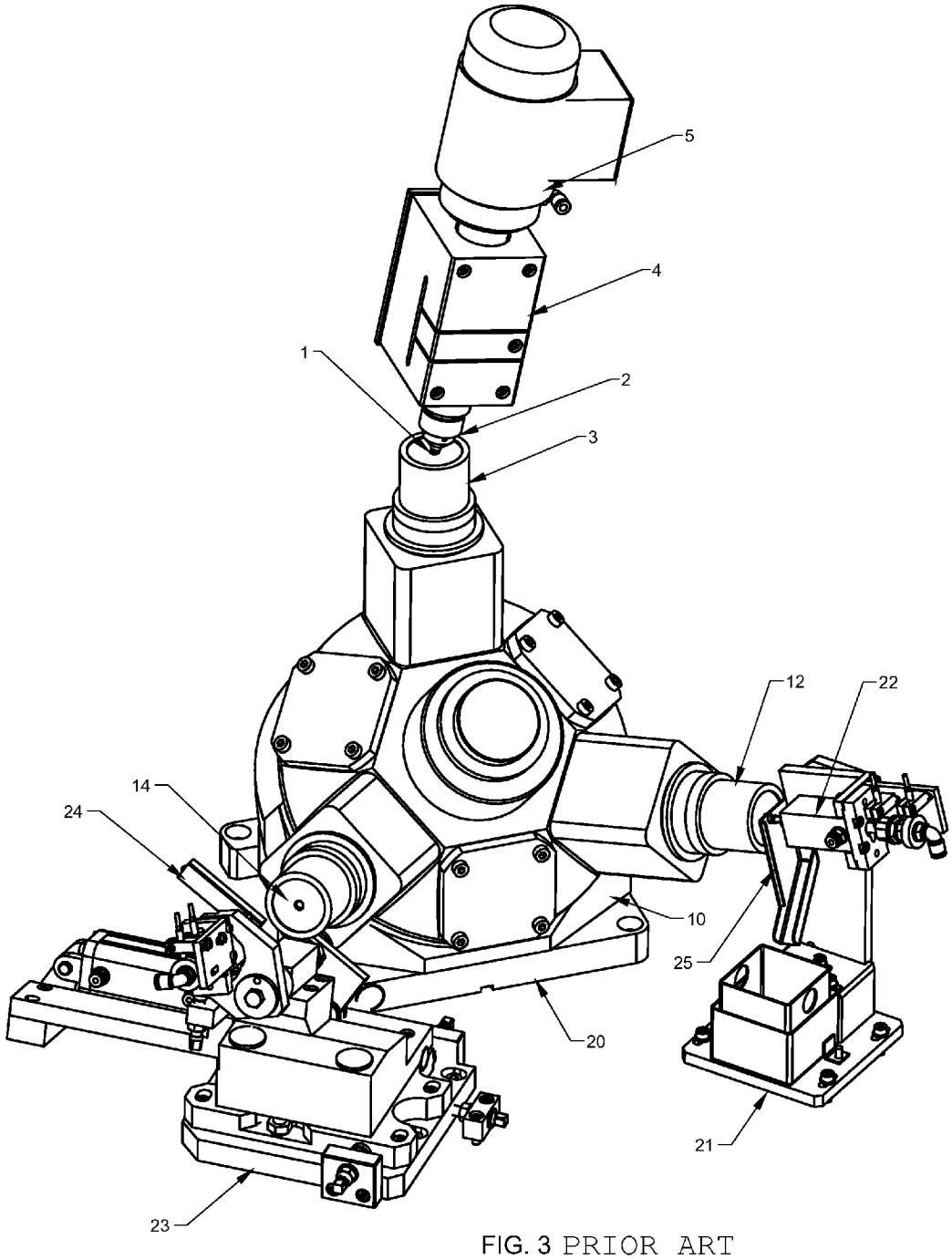
FIG. 3 PRIOR ART
FIG. 3 shows a first automated insertion and extraction system in which workpieces are inserted and extracted at different locations of the turret.

FIG. 3 shows a first automated insertion and extraction system in which workpieces 1, inside of chuck 3, are inserted and extracted at different location chucks 12, 14 of the turret 10. In this case, relatively simple single axis loading 23 and unloading 21 mechanisms may be employed. To load a workpiece 1, an empty chuck 14 is positioned at a loading station. Once in position, a workpiece 1, from a linear array of workpieces in chute 24, is presented with its axis aligned with the chuck 14, moved into the chuck 14, and the chuck 14 clamped (or otherwise closed) to hold the workpiece 1. To unload a workpiece 1, the turret 10 is positioned with the chuck 12 at an unloading station, and a mechanism 22 extended to grasp or catch the workpiece 1. The chuck 12 is then unlatched or released, and the workpiece 1 extracted from the chuck 12. In this type of system, the control for the loading and unloading may be closely or loosely integrated with the turret 10 control. As appropriate, sensors for turret position, availability of a new workpiece 1 in the loading chute 24 or space for a subsequent workpiece after extraction in the unload chute 25, state of alignment of insertion/extraction mechanism with chuck axis, and insertion/extraction status may be employed.

Figure 4:
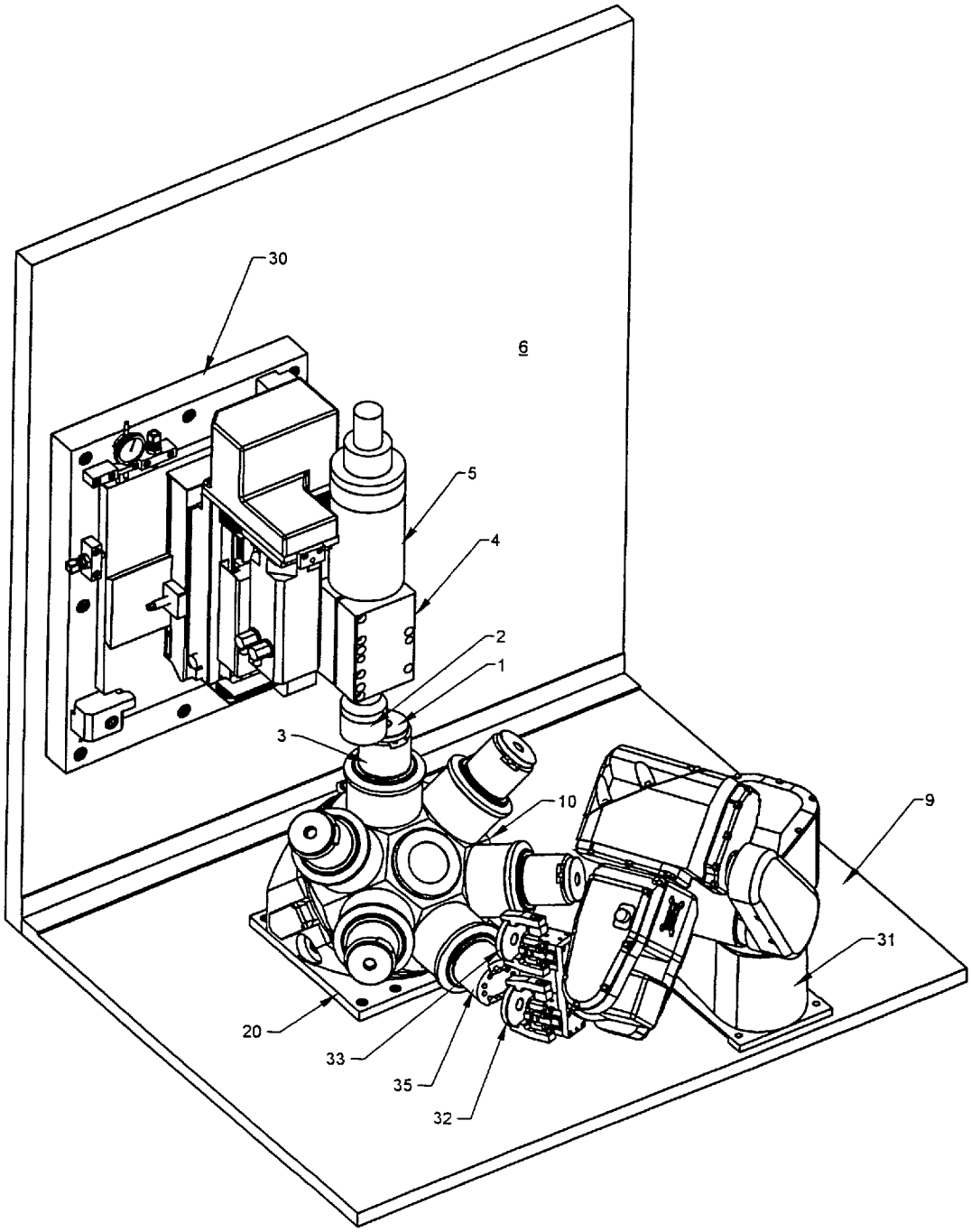
FIG. 4 shows a second automated insertion and extraction system in which workpieces are inserted and extracted at the same turret location.

FIG. 4 shows a second automated insertion and extraction system, in which workpieces 1 are inserted and extracted at the same turret 10 location. In this case, a single coordinated mechanism 31 inserts and extracts workpieces 1. Such mechanisms, exemplified by robotic arms, typically have a large number of degrees of freedom, and are typically controlled in both time and space to follow a predefined path. In contrast to the embodiment shown in FIG. 3, the system does not require that the workpieces 1 be precisely arrayed, and indeed they can be presented on a conveyor belt or tray. Workpieces 1 may be irregularly shaped or otherwise difficult to feed using a tube, chute, or ramp.

Also shown in FIG. 4 are that the robotic arm mechanism 31 and base 20 of turret 10 are mounted on a common base 9, which is rigidly connected to the vertical wall 6 supporting the cup wheel 2 positioning mechanism 30.

Since the robotic arm mechanism 31 requires sophisticated motion control, the control is typically separate from the turret 10 control and superfinishing control. Thus, the separate control may communicate over a link or network, such as Profibus, Ethernet (802.x), RS-232, RS-485, IEEE-1488, I2C, USB, IEEE-1394, IEEE-1451, or other known communication standard, or through a communication bus.

Second Embodiment

Figure 5:
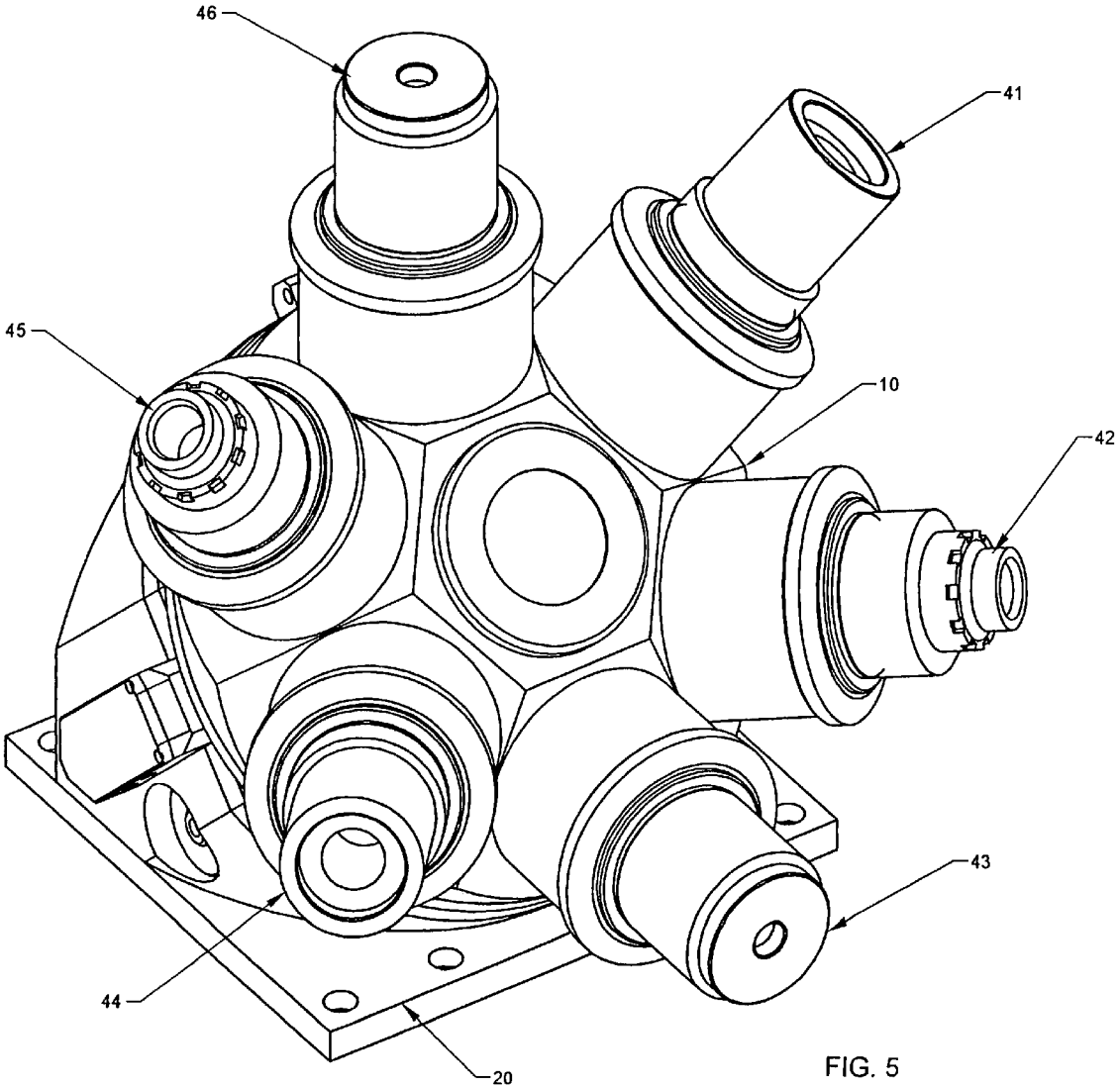
FIG. 5 shows a third embodiment of the invention in which multiple turret locations correspond to different processing operations, allowing the superfinishing machine to perform a plurality of different processing operations on different workflows without alternate setup.

FIG. 5 shows a second embodiment of the invention in which multiple turret 10 locations correspond to different processing operations, allowing the superfinishing machine to perform a plurality of different processing operations on different workflows without additional changeover.

This embodiment is structurally similar to the first embodiment shown in FIG. 2, except perhaps that multiple flows of workpieces 41, 42, 43, 44, 45, 46 may interact with the turret 10, to load and unload the respective chucks. However, from a control standpoint, this embodiment is somewhat different.

In prior systems, control complexity was limited by providing a system which was set up and run to perform a single operation. The cup wheel 2 and workpiece 1 each rotated about a defined axis, and the control used its process parameter sensor or a position sensor to initiate contact. Thereafter, the process was controlled to produce a finish on the workpiece with the desired parameters, which were, for example, dimensional, surface finish quality, or the like.

In this embodiment, the control has a program which is selected based on the turret 10 position of the respective workpiece 41, 42, 43, 44, 45, 46. Thus, with a six position turret 10, it is possible to have six different programs selected accordingly. By loading the workpiece 41, 42, 43, 44, 45, 46 into an appropriate chuck on the turret 10, the superfinishing process appropriate for that workpiece 41, 42, 43, 44, 45, 46 may be initiated and controlled.

According to another example, incoming parts may be gauged for various dimensions and parameters, and binned accordingly. Depending on the classification, the part may be selectively inserted into a respective turret 10 position, which will then trigger the appropriate processing conditions for that part. This alleviates the need to electronically communicate a new control program (or parameters thereof) to the control for each workpiece 41, 42, 43, 44, 45, 46.

Of course, the process control parameters need not be determined only by the turret 10 position, and a parameter associated with a part may be communicated to the process control independently of turret 10 position.

Third Embodiment

Figures 6A, 6B, 6C:
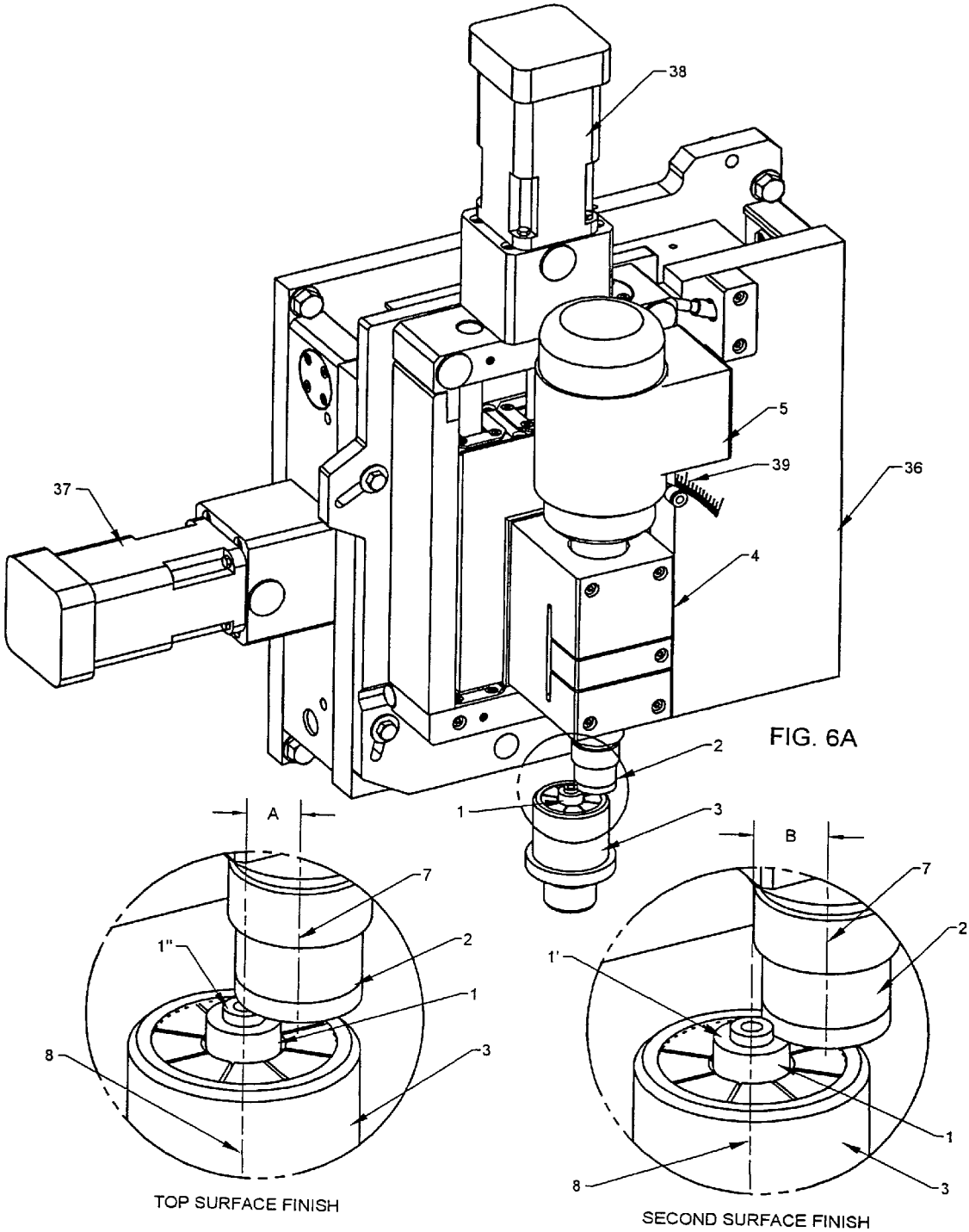
FIGS. 6A, 6B and 6C show a fourth embodiment of the invention in which a single workpiece is processed on different surfaces with respectively different processing parameters while mounted in the same chuck.

FIGS. 6A, 6B and 6C show a third embodiment of the invention in which a single workpiece 1 is processed on different surfaces 1', 1" with respectively different processing parameters while mounted in the same chuck 3. In this case, the control employs respectively different control parameters, if for nothing else, to define the offsets A, B of the various surfaces to be treated, but likely also in-process conditions as well. Accordingly, during processing, the control causes the cup wheel 2 to contact a first surface 1' and applies a respective treatment, until completed. After the first surface 1' is treated, a second processing program is triggered which then realigns the axes 7, 8 of the cup wheel 2 and workpiece 1. In some instances, the cup wheel 2 is replaced with a different abrasive, appropriate for the subsequent operation.

Using the next set of processing parameters, the subsequent surface 1" is treated. These sequential operations, calling sequential sets of control parameters, are repeated until all surfaces are treated. Therefore, a large number of surfaces on the same workpiece may be sequentially and efficiently processed. Because the feed system 4 is mounted on plate 36, with inclination adjustment 39, which, in turn is positioned by X axis servo 37 and Z axis servo 38, a high degree of precise control is available over the sequential processes. Further, the cup wheel repositioning mechanism allows precise and repeatable relative movements, ensuring that the surfaces 1', 1" of the workpiece 1 are accurately spaced relative to one another.

Figure 9:
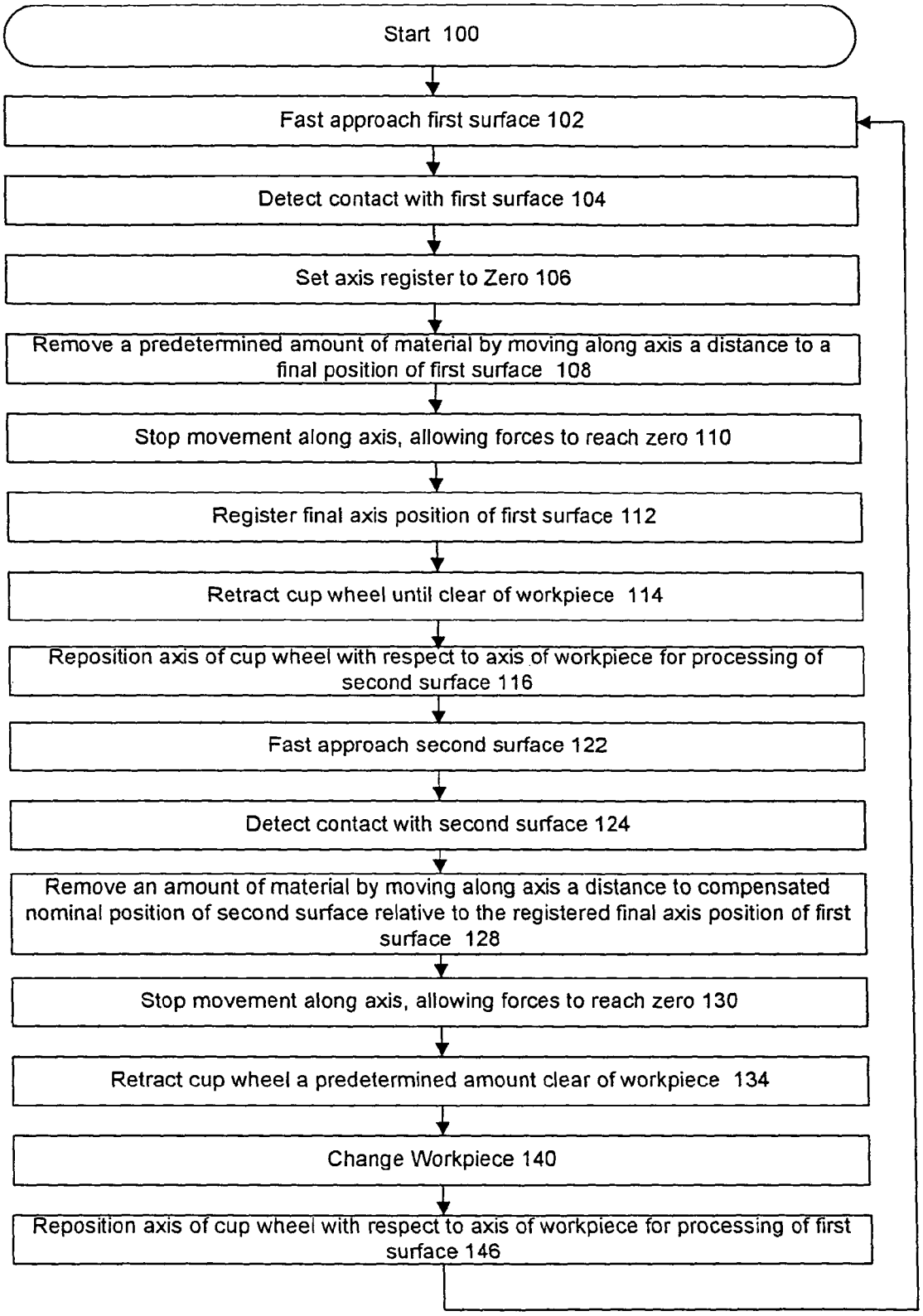
FIG. 9 shows a flowchart of a chained processing sequence in which a first surface is finished, and the position of the first surface used to form the second surface with high relative accuracy.

This process is shown in the flowchart of FIG. 9. The process starts 100 with a fast approach 102 to the first surface 1'. Initial contact of the cup wheel 2 with the workpiece 1 is detected 104, and the advance of the feed motor is immediately slowed. An axis register is set to zero 106, and a predetermined amount of material is removed from the workpiece 1 by advancing 108 the cup wheel 2 along its axis 7, until it reaches a depth corresponding to a desired material removal of the first surface 1'. The advance of the cup wheel 2 is then stopped 110, in a process step also known as spark out, and the forces between cup wheel 2 and workpiece 1 are allowed to drop to zero. The final axis position of the first surface 1' is then registered 112. The cup wheel 2 is then retracted 114 from the first surface 1' until clear of the workpiece 1, typically a predetermined distance.

The cup wheel 2 axis 7 is then repositioned 116 for finishing the second surface 1". The feed system 4 then advances the cup wheel 2 with a fast approach 122 toward the second surface 1". Contact with the second surface 1" is detected 124, and an amount of material is removed from the workpiece 1 by advancing 128 the cup wheel 2 along its axis 7, until it reaches a depth corresponding to a desired depth of the second surface 1", which is calculated relative to the first surface 1' registered final axis position 112, and which is typically compensated by a cup wheel 2 wear factor, if necessary to achieve a final tolerance. The advance of the cup wheel 2 is then stopped 130, and the forces between cup wheel 2 and workpiece 1 are allowed to drop to zero. The cup wheel 2 is then retracted 134 from the second surface 1" until clear of the workpiece 1. The workpiece 1 may then be changed to a new, unprocessed one, and the process repeated.

Fourth Embodiment

Figure 8:
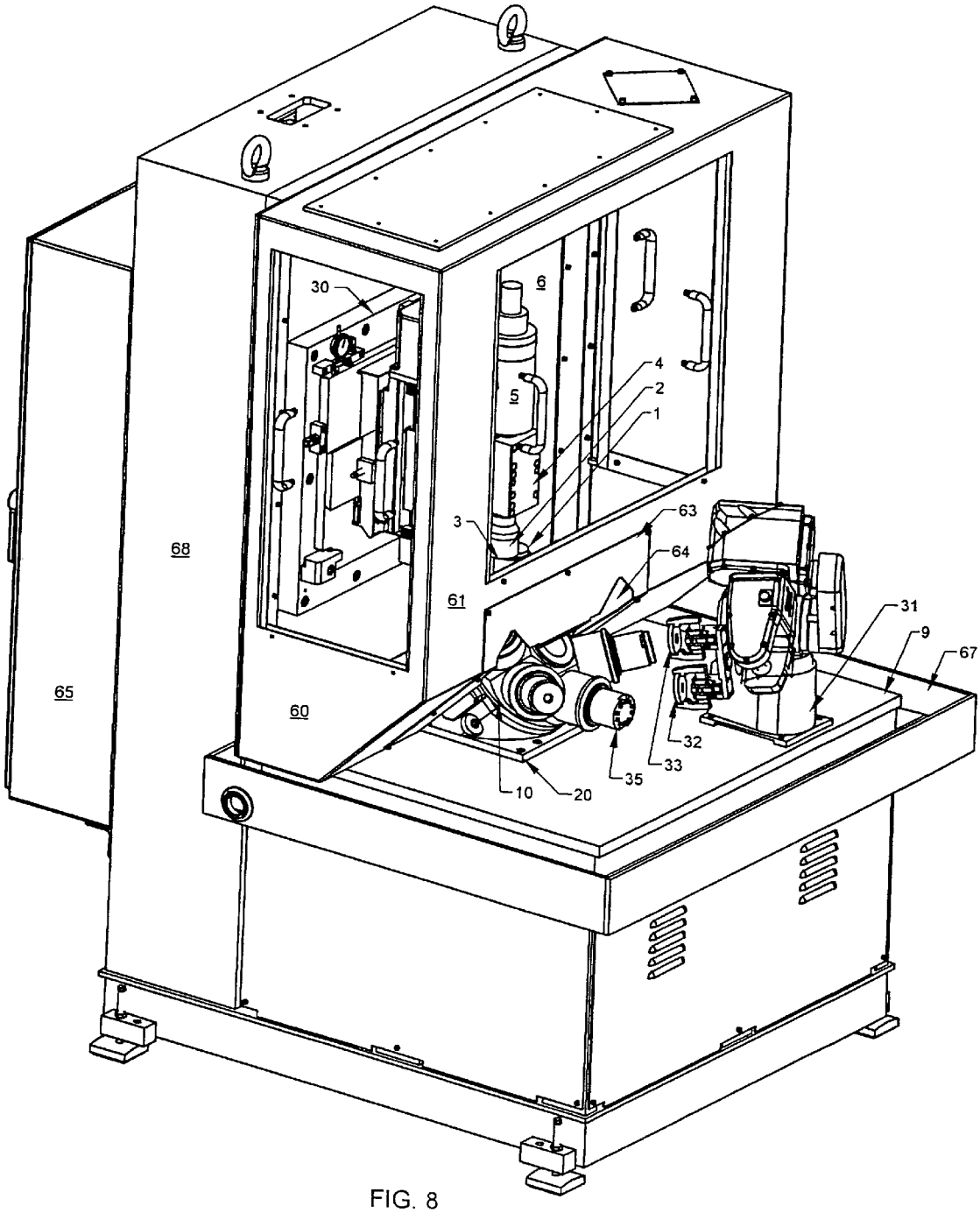
FIG. 8 shows a robotic arm embodiment of the present invention with a splash guard in place to protect the arm from a spray of cooling fluid.

As shown in FIG. 8, a shield may be provided around the cup wheel 2 and machining station of the turret 10, separating the machining space internal to the cabinet formed by front face 61, sides 60, rear support 68, and shield 63, from the loading and unloading space. This protects the robotic arm mechanism 31 from large flows of cooling fluid, and permits superfinishing to be conducted simultaneously with these ancillary operations. As shown in FIG. 8, the robotic arm mechanism 31 is mounted on the same table or base 9 as the turret 10, providing improved dimensional stability over a separate stand design.

The shield is part of a cabinet, with an inclined bottom 63, having a plane which generally bisects the turret 10. The shield 63 has, for example, cutouts 64 which conform to the shape of the turret 10 and chucks 3, 35. In this arrangement, and due to the right angle inclination of the bottom chuck 35 with respect to the top chuck 3, the loading and unloading operations may be readily separated from machining, even in close confines.

The robotic arm mechanism 31 preferably has a pair of grippers 32, 33, to allow insertion and extraction of workpieces 1 in a coordinated set of movements of the arm. Typically, the loading and unloading space is also enclosed in a guard (not shown) which, for example, provides operator safety and contains residual coolant spray, which drains into trough 67.

The control electronics for the apparatus are contained in a cabinet 65 on the rear of the rear support 68.

Fifth Embodiment

Figure 7:
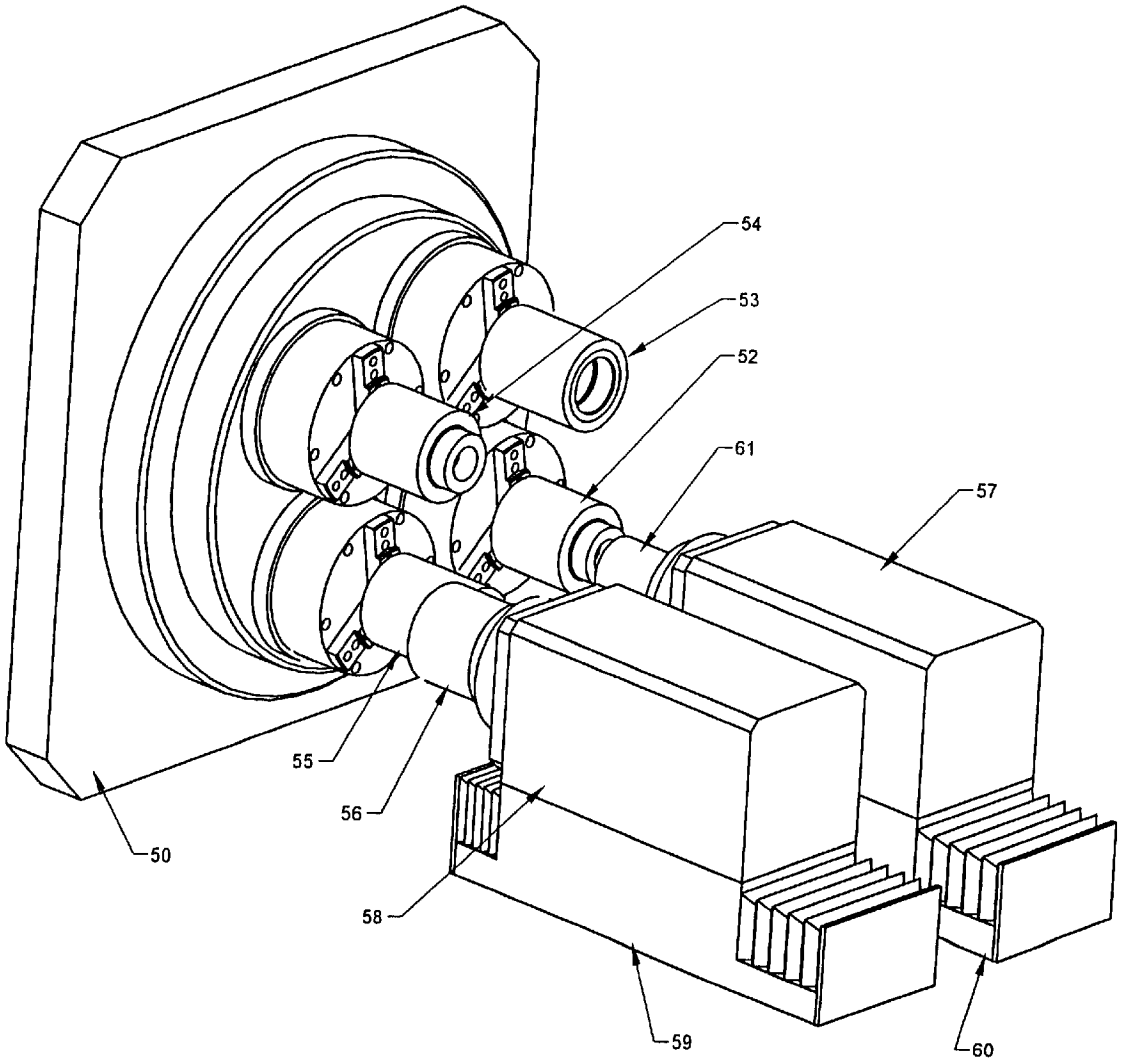
FIG. 7 shows a first index table embodiment of the invention wherein different workpieces are processed using different cup wheels simultaneously, and wherein the rotational axis of the index table can be continuously controlled.

FIG. 7 shows a direct drive index table 50 embodiment having two simultaneous machining positions 52, 55 for respectively different machining operations, for example, different operations on a workpiece. Because the index table 50 is direct drive, the axis of rotation of the workpiece 52, 54 may be controllably offset from a nominal position, providing an additional degree of freedom for machining. Thus, the cup wheel 56, 61 axes 7, driven by spindle motors 57, 58 may remain fixed in position, and the workpiece 52, 55 axis 8 offset in controlled manner, potentially simplifying the cup wheel positioning mechanisms 59, 60 to allow then to simply advance the cup wheel 56, 61.

In FIG. 7, it is seen that during processing of workpieces 52 and 55, workpieces 53 and 54 are accessible for gauging, insertion and extraction, or other operations.

While certain representative embodiments of the invention have been described herein for the purpose of illustration, it will be apparent to those skilled in the art that modifications therein may be made without departing from the spirit and scope of the invention.

The invention claimed is:

1. A superfinishing apparatus for generating a surface on a workpiece with a cup wheel, comprising:

(a) a rotationally driven cup wheel spindle having a cup wheel axis;

(b) a turret, having a plurality of workpiece chucks, each being repositionable about a turret rotation axis, between a working position having an axis substantially parallel to said cup wheel axis and at least one non-working position having an axis substantially inclined with respect to said cup wheel axis, a workpiece chuck in the working position clamping a workpiece and being rotationally driven with the workpiece chuck in the working position and a workpiece chuck in at least one non-working position being associated with a chuck unclamping mechanism adapted to unclamp a workpiece held therein, to thereby permit discharge or insertion of a workpiece;

(c) a coolant spray system adapted to spray coolant fluid on a workpiece mounted in the rotationally driven workpiece chuck in the working position;

(d) a spray shield, substantially shielding the spray of coolant fluid from the workpiece chuck in at least one non-working position;

(e) a programmable robotic arm having at least two independently controlled degrees of freedom of movement in time and space adapted to be selectively programmed to insert into and withdraw from the workpiece chuck in a single non-working position, a range of workpieces having different possible shapes, wherein a programming of the robotic arm is dependent on a shape of a respective workpiece, concurrently with the rotationally driven cup wheel operating on the a workpiece clamped in the rotationally driven chuck in the working position, wherein the automated mechanism is substantially shielded from the spray of coolant fluid by the shield spray; and (f) an automated control system adapted to control a spatial relationship of the cup wheel and the workpiece, the turret, and the programmable robotic arm.

2. A superfinishing apparatus for generating a surface on a workpiece with a cup wheel, comprising:

(a) a cup wheel spindle having a cup wheel axis;

(b) a plurality of workpiece chucks which each are rotatable about a respective chuck axis, each having a respective workpiece chuck axis, said plurality of workpiece chucks each being repositionable with respect to said cup wheel axis to selectively treat a workpiece in a respective workpiece chuck with said cup wheel; and (c) a programmable control, adapted to control a relative position of the cup wheel spindle and a workpiece chuck in a working position, to superfinish a selected surface of the workpiece in the workpiece chuck in the working position, wherein said programmable control of the superfinishing apparatus is adapted to apply a qualitatively different treatment to different workpieces in each respective workpiece chuck.

3. The superfinishing apparatus according to claim 2, further comprising:

an index table, having a repositioning axis, configured to rotationally drive the plurality of workpiece chucks, said index table being repositionable about said repositioning axis to provide a plurality of displaced potential contact positions between a cup wheel rotating about said cup wheel axis and a single workpiece rotating in one of the workpiece chucks.

4. The superfinishing apparatus according to claim 2 wherein at least one of said plurality of workpiece chucks is a duplicate and not in use during a respective machining operation, substituting for a failed workpiece chuck to permit continued operation prior to a repair.

5. The superfinishing apparatus according to claim 4, wherein the plurality of workpiece chucks are angularly repositionable with respect to the cup wheel axis.

6. The superfinishing apparatus according to claim 2, wherein the cup wheel axis and at least one workpiece chuck axis are angularly repositionable with respect to each other under direction of the programmable control.

7. A superfinishing apparatus in which a cup wheel and a workpiece chuck each rotate during contact of the cup wheel with the workpiece clamped in the workpiece chuck, subject to a spray of cooling fluid, to generate a surface, comprising:

a diagonal turret, having a diagonal turret axis, and having mounted thereon a plurality of workpiece chucks each having a respective spindle axis respectively diverging from the diagonal turret axis, a workpiece chuck positioned at a working position being adapted to be rotationally driven about the spindle axis under the spray of cooling fluid, whereby each of the plurality of chucks can each be used for processing workpieces when respectively positioned at the working position, and an unclamping mechanism in the diagonal turret adapted to selectively unclamp a workpiece when positioned in a non-working position, such that a workpiece can be inserted into or extracted from the workpiece chuck at a height along the rotational axis of the cup wheel different than the surface, a shield having a fixed position with respect to the cup wheel provided to substantially separate the spray of cooling fluid on the workpiece in the working position from at least one of the plurality of workpiece chucks in the non-working position; and a control adapted to control a position of the diagonal turret about the diagonal turret axis, the unclamping mechanism, and a relative position of the cup when and the workpiece, to effect a superfinishing process on the workpiece concurrently with an extraction of a workpiece from, and an insertion of a workpiece into, a workpiece chuck positioned at the non-working position outside the shield.

8. A superfinishing apparatus which performs a superfinishing operation on a workpiece in which a cup wheel and a workpiece chuck each rotate during contact of the cup wheel with the workpiece clamped in the chuck, to generate a superfinished surface, comprising:

a revolving table having a plurality of workpiece chucks, each mounted for concurrent driven rotation about a respective spindle axis, the plurality of chucks being adapted to receive and concurrently process respectively different types of workpieces;

a plurality of rotationally driven cup wheels; and an automated control, adapted to determine a respectively different process to be applied to each different type of workpiece, and to control the revolving table, and a relative position of the respective workpiece chucks and the plurality of cup wheels during concurrent performance of the respectively different processes.

9. The superfinishing apparatus according to claim 8, wherein a revolution of the table causes a change in an angle between an axis of rotation of the cup wheel and an axis of rotation of at least one workpiece chuck.

10. A superfinishing apparatus in which a cup wheel and a workpiece chuck each rotate along respectively different axes during contact of the cup wheel with the workpiece clamped in the chuck, to generate a superfinished surface, comprising:

a table having an incrementally controllable axis of revolution, supporting the workpiece chuck for rotation about a respective spindle axis, a displacement of the table about the axis of revolution varying a relation of the rotational axis of the cup wheel with respect to the rotational axis of the workpiece for respectively different contact positions of the cup wheel on the workpiece; and a control adapted to control an incremental rotation of the table about the axis of revolution concurrent with a contact of the rotating cup wheel with the rotating workpiece, and to further control an axial displacement of the rotating cup wheel with respect to the rotating workpiece.

11. The superfinishing apparatus according to claim 10, wherein a rotation of the table causes a change in a relative angle between the axis of the cup wheel and the spindle axis.

12. A superfinishing apparatus in which a cup wheel and a workpiece chuck each rotate along respectively different axes during contact of the cup wheel with the workpiece clamped in the chuck, to generate a surface, comprising:

a table having an incrementally controllable axis of revolution supporting the workpiece chuck for rotation about a respective spindle axis, having a first displacement of the table about the axis of revolution providing a relative positioning of the cup wheel and the workpiece chuck for a first machining operation at a first depth along the spindle axis, and a second displacement of the table about the axis of revolution providing a relative positioning of the cup wheel and the workpiece chuck for a second machining operation at a second depth along the spindle axis; and a control adapted to receive control information for the first machining operation and the second machining operation, and to control an incremental rotation of the table about the controllable axis of revolution, and to further control an axial displacement of the rotating cup wheel with respect to the rotating workpiece, to perform the first second machining operation and then the second machining operation, wherein the second machining operation is selectively dependent on a parameter determined as a result of the first machining operation.

13. The superfinishing apparatus according to claim 12, wherein the control is configured for controlling the first machining operation, followed without unclamping the workpiece by the second machining operation.

14. The superfinishing apparatus according to claim 12, wherein the cup wheel and the workpiece chuck are each adapted for rotation during contact of the cup wheel with a workpiece clamped in the workpiece chuck under a stream of fluid, further comprising a multi-axis robotic arm mounted on a common base with the workpiece chuck configured for selectively inserting into and withdrawing workpieces from the workpiece chuck, and a splash guard configured for substantially protecting the robotic arm from the stream of fluid.

15. The superfinishing apparatus according to claim 12, wherein a repositioning of the table about the axis of revolution results in a change in an angle between an axis of rotation of the cup wheel axis and the spindle axis.

16. The superfinishing apparatus according to claim 12, wherein a rotation of the table causes a change in a relative angle between the axis of the cup wheel and the spindle axis.

17. The superfinishing apparatus according to claim 13, wherein the axis of the cup wheel and the workpiece chuck are angularly repositionable with respect to each other.

18. The superfinishing apparatus according to claim 14, wherein the workpiece chuck is mounted on a revolving table, and wherein a cup wheel spindle axis and a workpiece chuck axis of rotation are angularly displaced by a revolution of the table.

19. A superfinishing apparatus in which a cup wheel and a workpiece chuck each rotate during contact of the cup wheel with the workpiece clamped in the chuck at a machining position, to generate a surface, comprising:

a revolving table having a plurality of workpiece chucks, each mounted for rotation about a respective spindle axis, a multiaxis robotic arm for selectively inserting into and withdrawing workpieces from an unclamped chuck at a non-machining position, a common base, wherein the table and the robotic arm are each mounted on the common base; and a control adapted to position the revolving table about an axis of revolution, to control a position of the multiaxis robotic arm with respect to a workpiece chuck, to control an unclamping of the workpiece chuck, wherein a high relative accuracy of alignment of the multiaxis robotic arm with respect to revolving table is ensured by the common base.

20. The superfinishing apparatus according to claim 19, wherein a revolution of the table changes a respective angle between at least one spindle axis and an axis of rotation of the cup wheel.

21. A superfinishing apparatus comprising:

a cup wheel spindle; and a workpiece chuck, each being adapted for rotation during contact of the cup wheel with the workpiece clamped in the chuck under a stream of fluid, to generate a superfinished surface, the workpiece chuck being mounted on a diagonal turret having a diagonal turret axis of rotation, having a plurality of chucks each having a chuck axis which respectively diverges from the diagonal turret axis;

a fluid shield for separating:

a machining space enclosing the cup wheel, a rotationally driven workpiece chuck, and the stream of fluid, and a non-machining space with at least one of the plurality of chucks, a workpiece chuck unclamping mechanism being provided to selectively unclamp the at least one of the plurality of chucks in the non-machining space while maintaining a clamping of the rotationally driven workpiece chuck in the machining space, and a control adapted to control a relative position of the cup wheel spindle and the workpiece, and to control an axis of rotation of the diagonal turret, and to control the unclamping mechanism.

22. A superfinishing apparatus for generating a surface on a workpiece with a cup wheel, comprising:

(a) a cup wheel spindle having a cup wheel axis;

(b) a moveable support, having a plurality of workpiece chucks, at least one of said workpiece chucks being rotationally driven about a workpiece chuck axis, said moveable support being repositionable between a plurality of displaced positions to thereby reposition the respective chuck axes of the workpiece chucks, at least one of said workpiece chucks being positionable with respect to the cup wheel axis at a superfinishing position, wherein in each respective displaced position a spatial relationship of said cup wheel axis with respect to a respective workpiece chuck is different, and wherein:

(i) a robotic arm is provided for selectively inserting into and withdrawing workpieces from one of said workpiece chucks which is not at a superfinishing position, and a common base is provided, wherein said repositionable support and robotic arm are each mounted on said common base; and (ii) a fluid shield is provided to separate a machining space in which a stream of fluid is directed at a workpiece mounted in a workpiece chuck at the superfinishing position, and at least one other of said plurality of workpiece chucks not at the superfinishing position; and (c) a control system, adapted to control a positioning of the movable support, and to concurrently control a relative position of the cup wheel spindle with respect to the workpiece and a position of the robotic arm.

* * * * *